US009128429B1

(12) United States Patent
Phelps et al.

(10) Patent No.: US 9,128,429 B1
(45) Date of Patent: Sep. 8, 2015

(54) EXTERNAL HEAT ROLL SCRAPER BLADE AND AUGER

(71) Applicant: XEROX CORPORATION, Norwalk, CT (US)

(72) Inventors: Robert W. Phelps, Victor, NY (US); Erwin Ruiz, Rochester, NY (US); Paul M. Fromm, Rochester, NY (US); Steven M. Russel, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/266,267

(22) Filed: Apr. 30, 2014

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2014; G03G 15/2017; G03G 15/2021; G03G 15/2057; G03G 15/2053
USPC ..... 399/329–331, 333
See application file for complete search history.

(56) References Cited

U.S. PATENT DOCUMENTS

| | | | | |
|---|---|---|---|---|
| 4,252,435 | A | 2/1981 | Manghirmalani | |
| 7,010,255 | B2 * | 3/2006 | Yura et al. | 399/328 |
| 8,131,170 | B2 | 3/2012 | Kurz | |
| 2010/0061778 | A1 * | 3/2010 | Kagawa | 399/327 |

* cited by examiner

*Primary Examiner* — Walter L Lindsay, Jr.
*Assistant Examiner* — Jessica L Eley
(74) *Attorney, Agent, or Firm* — Ronald E. Prass, Jr.; Prass LLP

(57) ABSTRACT

An image forming device is provided that includes a fuser section having a carbon nanotube fuser roll; a pressure roll that interacts with the fuser roll to create a nip; an external heat roll that contacts the fuser roll and transfers heat to the fuser roll; and a cleaning system for cleaning contamination deposits from the external heat roll. The cleaning system has a scraper blade configured to contact a surface of the external heat roll such that the deposits are scraped from the surface of the external heat roll; a catch tray positioned relative to the scraper blade such that the deposits scraped from the surface of the external heat roll by the scraper blade are collected by the catch tray; and a deposit transportation auger located in the catch tray, the auger being configured to transport the deposits from the catch tray to a collection box.

20 Claims, 2 Drawing Sheets

EXTERNAL HEAT ROLL SCRAPER BLADE AND AUGER

BACKGROUND

Disclosed herein is a system and method for cleaning deposits from an external heat roll in an image forming apparatus.

Embodiments of the disclosure are well suited for cleaning deposits from external heat rolls that contact a carbon nanotube fuser roll.

SUMMARY

Some image forming devices, for example some image forming devices that use a toner, have one or more external heat rolls that transfer heat to a fuser roll that fuses an image on a piece of media. Deposits such as, for example, toner dirt can accumulate on the external heat rolls during use of the image forming device. It is desirable to remove these deposits to maintain the desired print quality and heat transfer of the device.

Some image forming devices use a cleaning web that is pressed against the external heat rolls to remove deposits. Applicants have discovered that such a cleaning web does not always provide a level of deposit removal desired in some modern image forming devices. For example, an image forming device that operates at a higher speed than other image forming devices, for example a device that uses a carbon nanotube fuser roll, can have an increased toner dirt contamination rate as compared to image forming devices having a slower operating speed. To address at least this increased toner dirt contamination rate, embodiments of the disclosure provide aggressive scraping blades instead of a cleaning web to remove deposits from the external heat rolls. Embodiments of the disclosure can also provide an auger system for removing the deposits from a catch tray after the deposits have been removed from the external heat rolls.

An embodiment of the disclosure may include an image forming device that forms an image on a piece of media. The device can have a fuser section having a carbon nanotube fuser roll; a pressure roll that interacts with the carbon nanotube fuser roll to create a nip through which the piece of media travels; a first external heat roll that contacts the carbon nanotube fuser roll and transfers heat to the carbon nanotube fuser roll; and a cleaning system for cleaning contamination deposits from the first external heat roll. The cleaning system can have a scraper blade configured to contact a surface of the first external heat roll such that the deposits are scraped from the surface of the first external heat roll; a catch tray positioned relative to the scraper blade such that the deposits scraped from the surface of the first external heat roll by the scraper blade are collected by the catch tray; and a deposit transportation auger located in the catch tray, the auger being configured to transport the deposits from the catch tray to a collection box. The device can also have a media supply transport the transports the piece of media to the nip; and a media removal transport that transports the piece of media from the nip.

Another embodiment of the disclosure may include a fuser section of an image forming device that forms an image on a piece of media. The fuser section can have a carbon nanotube fuser roll; a pressure roll that interacts with the carbon nanotube fuser roll to create a nip through which the piece of media travels; a first external heat roll that contacts the carbon nanotube fuser roll and transfers heat to the carbon nanotube fuser roll; and a cleaning system for cleaning contamination deposits from the first external heat roll. The cleaning system can have a scraper blade configured to contact a surface of the first external heat roll such that the deposits are scraped from the surface of the first external heat roll, a catch tray positioned relative to the scraper blade such that the deposits scraped from the surface of the first external heat roll by the scraper blade are collected by the catch tray, and a deposit transportation auger located in the catch tray, the auger being configured to transport the deposits from the catch tray to a collection box.

Another embodiment of the disclosure may include a method of cleaning contamination deposits from an external heat roll of an image forming device that forms an image on a piece of media. The method can include providing a fuser section having a carbon nanotube fuser roll, a pressure roll that interacts with the carbon nanotube fuser roll to create a nip through which the piece of media travels, and a first external heat roll that contacts the carbon nanotube fuser roll and transfers heat to the carbon nanotube fuser roll; cleaning the contamination deposits from the first external heat roll by contacting a surface of the first external heat roll with a scraper blade such that the deposits are scraped from the surface of the first external heat roll by the scraper blade; collecting the deposits scraped from the surface of the first external heat roll by the scraper blade in a catch tray positioned relative to the scraper blade such that the deposits scraped from the surface of the first external heat roll by the scraper blade are collected by the catch tray; and transporting the deposits from the catch tray to a collection box with a deposit transportation auger located in the catch tray.

DETAILED DESCRIPTION

Figure 1:
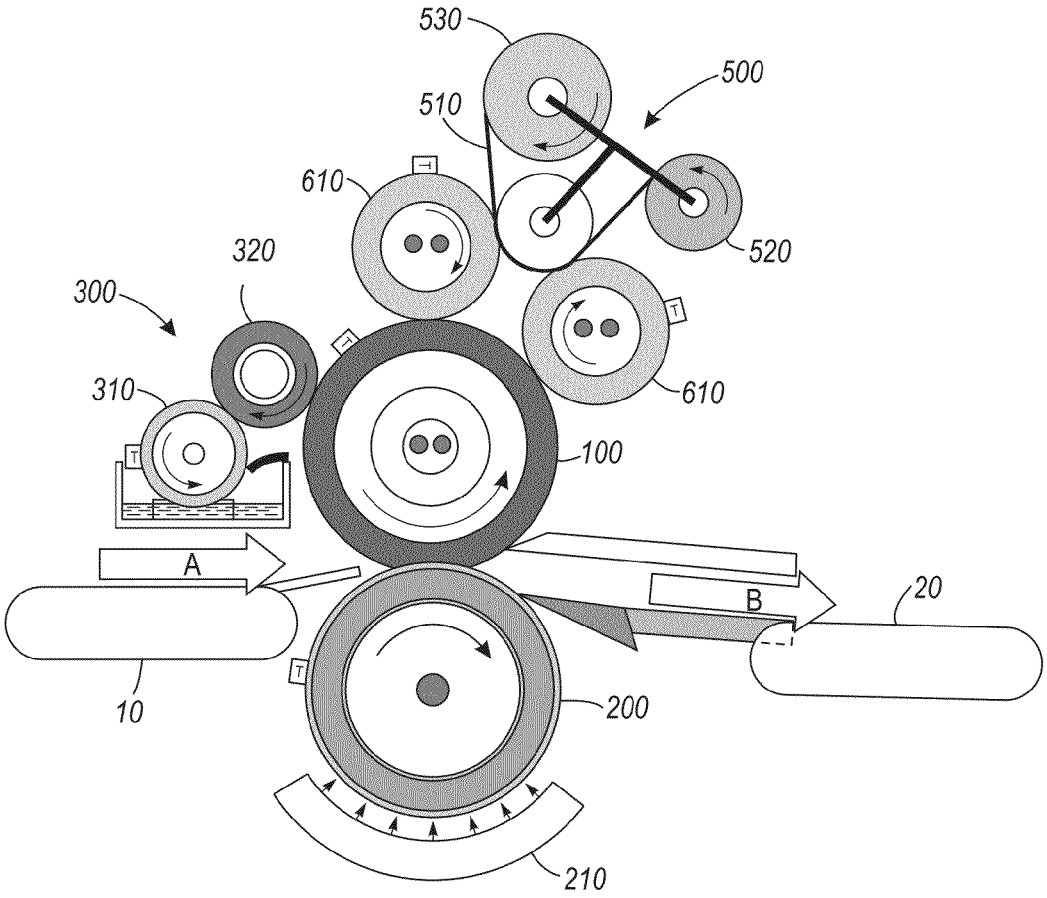
FIG. 1 is a schematic view of an image forming device that uses a cleaning web.

Aspects of the embodiments disclosed herein relate to systems and methods of cleaning external heat rolls in an image forming device.

The disclosed embodiments may include an image forming device that forms an image on a piece of media. The device can have a fuser section having a carbon nanotube fuser roll; a pressure roll that interacts with the carbon nanotube fuser roll to create a nip through which the piece of media travels; a first external heat roll that contacts the carbon nanotube fuser roll and transfers heat to the carbon nanotube fuser roll; and a cleaning system for cleaning contamination deposits from the first external heat roll. The cleaning system can have a scraper blade configured to contact a surface of the first external heat roll such that the deposits are scraped from the surface of the first external heat roll; a catch tray positioned relative to the scraper blade such that the deposits scraped from the surface of the first external heat roll by the scraper blade are collected by the catch tray; and a deposit transportation auger located in the catch tray, the auger being configured to transport the deposits from the catch tray to a collection box. The device can also have a media supply transport the transports the piece of media to the nip; and a media removal transport that transports the piece of media from the nip.

The disclosed embodiments may further include a fuser section of an image forming device that forms an image on a piece of media. The fuser section can have a carbon nanotube fuser roll; a pressure roll that interacts with the carbon nanotube fuser roll to create a nip through which the piece of media travels; a first external heat roll that contacts the carbon nanotube fuser roll and transfers heat to the carbon nanotube fuser roll; and a cleaning system for cleaning contamination deposits from the first external heat roll. The cleaning system can have a scraper blade configured to contact a surface of the first external heat roll such that the deposits are scraped from the surface of the first external heat roll, a catch tray positioned relative to the scraper blade such that the deposits scraped from the surface of the first external heat roll by the scraper blade are collected by the catch tray, and a deposit transportation auger located in the catch tray, the auger being configured to transport the deposits from the catch tray to a collection box.

The disclosed embodiments may further include a method of cleaning contamination deposits from an external heat roll of an image forming device that forms an image on a piece of media. The method can include providing a fuser section having a carbon nanotube fuser roll, a pressure roll that interacts with the carbon nanotube fuser roll to create a nip through which the piece of media travels, and a first external heat roll that contacts the carbon nanotube fuser roll and transfers heat to the carbon nanotube fuser roll; cleaning the contamination deposits from the first external heat roll by contacting a surface of the first external heat roll with a scraper blade such that the deposits are scraped from the surface of the first external heat roll by the scraper blade; collecting the deposits scraped from the surface of the first external heat roll by the scraper blade in a catch tray positioned relative to the scraper blade such that the deposits scraped from the surface of the first external heat roll by the scraper blade are collected by the catch tray; and transporting the deposits from the catch tray to a collection box with a deposit transportation auger located in the catch tray.

As discussed above, some image forming devices that have one or more external heat rolls can accumulate deposits on the external heat rolls during use of the image forming device. Proper removal of these deposits in image forming devices that operate at higher speeds is a problem that has been addressed by embodiments of the disclosure. An example of such a device is one that uses a carbon nanotube fuser roll.

A carbon nanotube fuser roll has a higher thermal conductivity than some conventional fuser rolls. This advantageously enables fusing at higher speeds because heat is transferred at a faster rate from the external heat rolls to the fuser roll and from the fuser roll to the media on which the image is formed. This, in turn, can result in increased productivity. This higher operating speed can, however, result in an increase in the rate at which toner dirt accumulates on the external heat rolls that provide heat to the carbon nanotube fuser roll. This increase can also be the result of the interaction between the carbon nanotube fuser roll and the pressure roll in conjunction with a rough media finish and/or particular image types (for example, halftone images). Generally, the rougher the surface of the media, the more contamination that is generated. Also, halftone images have un-fused toner particles that result in a higher level of contamination. The higher operating speeds made possible by a carbon nanotube fuser roll in conjunction with halftone images on rough media can result in a very high level of contamination.

Embodiments of the disclosure address this problem by using aggressive scraping blades (for example, steel scraping blades) to scrape particulate contamination off of the external heat rolls and transport the removed contamination by using an auger in a catch tray.

FIG. 1 shows an example of an image forming device that uses a web system to clean external heat rolls. In FIG. 1, a fuser roll 100 and a pressure roll 200 are pressed against each other to form a nip through which a piece of media containing an image is passed from transport 10 (arrow A) to transport 20 (arrow B) in order to fuse the image to the piece of media. In this example, pressure roll 200 is cooled by a pressure roll cooler 210. A release agent supply system 300 applies a release agent to fuser roll 100 by way of a meter roll 310 and a donor roll 320.

In FIG. 1, heat is supplied to fuser roll 100 by way of two external heat rolls 610. As described above, external heat rolls 610 can accumulate deposits that are transferred to external heat rolls 610 from fuser roll 100. External heat rolls 610 are cleaned by an external heat roll cleaning system 500. External heat roll cleaning system 500 uses a cleaning web 510 that is moved across the external surfaces of external heat rolls 610. Cleaning web 510 is supplied by a web supply 520 and is stored after use on a web take-up 530. When the entire length of cleaning web 510 has been used, a new cleaning web must be provided.

Figure 2:
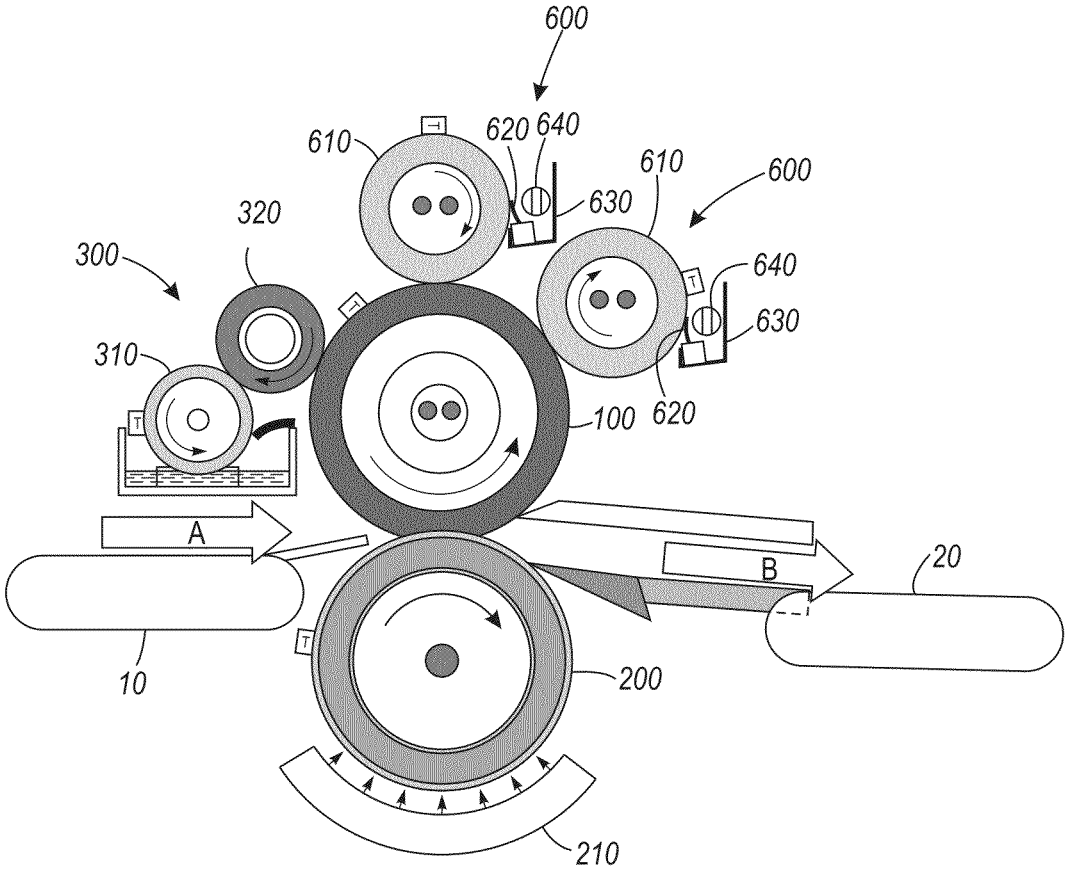
FIG. 2 is a schematic view of an exemplary embodiment of the disclosure that uses scraper blades.

FIG. 2 shows an embodiment of the disclosure that replaces external heat roll cleaning system 500 of FIG. 1 with an external heat roll cleaning system 600 that does not use a web. Applicants discovered that the high level of contamination that results from higher speeds and rough media and/or halftone images is not always properly handled by an external heat roll cleaning system, such as cleaning system 500, that uses a web. As a result, embodiments of the disclosure use an external heat roll cleaning system such as external heat roll cleaning system 600.

External heat roll cleaning system 600 includes a scraper blade 620 that is pressed against an external surface of external heat roll 610 in order to aggressively scrape deposits from external heat roll 610. Deposits scraped from external heat roll 610 by scraper blade 620 are collected by a catch tray 630. Scraper blade 620 can, for example, be a metal such as, for example, steel. Due to the high volume of deposits described above, a dirt transport auger 640 is provided in catch tray 630 in order to move the removed deposits, in this example axially into the page of FIG. 2, for collection in a large collection box (not shown).

Embodiments of the disclosure use external heat rolls 610 that are hard coat anodized (or are otherwise hard) so that they can withstand aggressive scraping by scraper blades 620. External heat rolls 610 can have a rough exterior surface. The above-described scraping can help keep the rough surface of exterior heat rolls 610 from becoming glazed over and, therefore, losing their roughness. It is desirable to properly set the contact force and hardness of scraper blade 620 and external heat roll 610 such that the wearing away of the roughness of external heat roll 610 is balanced with proper cleaning. Embodiments of the disclosure provide scraper blade 620 having a length that is equal to or greater than the length of external heat roll 610.

In addition to providing better cleaning of the external heat rolls when compared to a web-based cleaning system, embodiments of the disclosure reduce maintenance costs because scraper blades 620 are significantly less expensive than cleaning webs.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image forming device that forms an image on a piece of media, the device comprising:

a fuser section having a carbon nanotube fuser roll;

a pressure roll that interacts with the carbon nanotube fuser roll to create a nip through which the piece of media travels;

a first external heat roll that contacts the carbon nanotube fuser roll and transfers heat to the carbon nanotube fuser roll; and a cleaning system for cleaning contamination deposits from the first external heat roll, the cleaning system having a scraper blade configured to contact a surface of the first external heat roll such that the deposits are scraped from the surface of the first external heat roll;

a catch tray positioned relative to the scraper blade such that the deposits scraped from the surface of the first external heat roll by the scraper blade are collected by the catch tray; and a deposit transportation auger located in the catch tray, the auger being configured to transport the deposits from the catch tray to a collection box;

a media supply transport that transports the piece of media to the nip; and a media removal transport that transports the piece of media from the nip.

2. The device of claim 1, wherein the first external heat roll is hard cast anodized.

3. The device of claim 2, wherein the scraper blade is the only cleaning device that contacts the first external heat roll.

4. The device of claim 3, wherein the scraper blade is metal.

5. The device of claim 1, wherein the scraper blade is the only cleaning device that contacts the first external heat roll.

6. The device of claim 1, wherein the first external heat roll is hard cast anodized, and scraper blade is metal.

7. The device of claim 1, further comprising a second external heat roll; and a second cleaning system for cleaning contamination deposits from the second external heat roll, the second cleaning system having a second scraper blade configured to contact a surface of the second external heat roll such that the deposits are scraped from the surface of the second external heat roll;

a second catch tray positioned relative to the second scraper blade such that the deposits scraped from the surface of the second external heat roll by the second scraper blade are collected by the second catch tray; and a second deposit transportation auger located in the second catch tray, the second auger being configured to transport the deposits from the second catch tray to one of the collection box or a second collection box.

8. A fuser section of an image forming device that forms an image on a piece of media, the fuser section comprising:

a carbon nanotube fuser roll;

a pressure roll that interacts with the carbon nanotube fuser roll to create a nip through which the piece of media travels;

a first external heat roll that contacts the carbon nanotube fuser roll and transfers heat to the carbon nanotube fuser roll; and a cleaning system for cleaning contamination deposits from the first external heat roll, the cleaning system having a scraper blade configured to contact a surface of the first external heat roll such that the deposits are scraped from the surface of the first external heat roll, a catch tray positioned relative to the scraper blade such that the deposits scraped from the surface of the first external heat roll by the scraper blade are collected by the catch tray, and a deposit transportation auger located in the catch tray, the auger being configured to transport the deposits from the catch tray to a collection box.

9. The fuser section of claim 8, wherein the first external heat roll is hard cast anodized.

10. The fuser section of claim 9, wherein the scraper blade is the only cleaning device that contacts the first external heat roll.

11. The fuser section of claim 10, wherein the scraper blade is metal.

12. The fuser section of claim 8, wherein the scraper blade is the only cleaning device that contacts the first external heat roll.

13. The fuser section of claim 8, wherein the first external heat roll is hard cast anodized, and scraper blade is metal.

14. The fuser section of claim 8, further comprising a second external heat roll; and a second cleaning system for cleaning contamination deposits from the second external heat roll, the second cleaning system having a second scraper blade configured to contact a surface of the second external heat roll such that the deposits are scraped from the surface of the second external heat roll;

a second catch tray positioned relative to the second scraper blade such that the deposits scraped from the surface of the second external heat roll by the second scraper blade are collected by the second catch tray; and a second deposit transportation auger located in the second catch tray, the second auger being configured to transport the deposits from the second catch tray to one of the collection box or a second collection box.

15. A method of cleaning contamination deposits from an external heat roll of an image forming device that forms an image on a piece of media, the method comprising:

providing a fuser section having a carbon nanotube fuser roll;

a pressure roll that interacts with the carbon nanotube fuser roll to create a nip through which the piece of media travels; and a first external heat roll that contacts the carbon nanotube fuser roll and transfers heat to the carbon nanotube fuser roll;

cleaning the contamination deposits from the first external heat roll by contacting a surface of the first external heat roll with a scraper blade such that the deposits are scraped from the surface of the first external heat roll by the scraper blade;

collecting the deposits scraped from the surface of the first external heat roll by the scraper blade in a catch tray positioned relative to the scraper blade such that the deposits scraped from the surface of the first external heat roll by the scraper blade are collected by the catch tray; and transporting the deposits from the catch tray to a collection box with a deposit transportation auger located in the catch tray.

16. The method of claim 15, wherein the first external heat roll is hard cast anodized.

17. The method of claim 16, wherein the scraper blade is the only cleaning device that contacts the first external heat roll.

18. The method of claim 17, wherein the scraper blade is metal.

19. The method of claim 15, wherein the scraper blade is the only cleaning device that contacts the first external heat roll.

20. The method of claim 15, wherein the first external heat roll is hard cast anodized, and scraper blade is metal.

* * * * *